US006135425A

United States Patent [19]

Platt

[11] Patent Number: 6,135,425

[45] Date of Patent: Oct. 24, 2000

[54] FENCE CONNECTOR AND A METHOD OF ASSEMBLING FENCES

[76] Inventor: Robert E. Platt, 8701 Highland Ave., Mineral Ridge, Ohio 44440

[21] Appl. No.: 08/974,301

[22] Filed: Nov. 19, 1997

Related U.S. Application Data

[63] Continuation-in-part of application No. 08/715,814, Sep. 16, 1996, abandoned.

[51] Int. Cl.[7] ..... E04H 17/14

[52] U.S. Cl. ..... 256/66; 256/65; 403/408.1; 411/508; 24/297; 24/453

[58] Field of Search ..... 256/66, 65, 19, 256/24, 73; 411/508, 509, 510; 24/297, 453; 403/397, 396, 400, 408.1, DIG. 14

[56] References Cited

U.S. PATENT DOCUMENTS

| | | | |
|---|---|---|---|
| 194,724 | 8/1877 | Reed et al. . | |
| 3,955,801 | 5/1976 | Soriero, Jr. | 256/65 |
| 4,027,855 | 6/1977 | Lauzier | 256/65 X |
| 4,159,592 | 7/1979 | Gabriel | 411/508 X |
| 4,373,826 | 2/1983 | Inamoto et al. . | |
| 4,495,380 | 1/1985 | Ryan et al. | 411/508 X |
| 4,524,494 | 6/1985 | Sato et al. . | |
| 4,604,776 | 8/1986 | Takahashi | 24/297 X |
| 4,691,897 | 9/1987 | Frush | 256/65 |
| 4,821,481 | 4/1989 | Woodman . | |
| 4,920,618 | 5/1990 | Iguchi | 24/453 |
| 5,255,897 | 10/1993 | Pepper | 256/66 X |
| 5,445,362 | 8/1995 | Reppert . | |
| 5,509,182 | 4/1996 | Nakanishi | 411/508 X |
| 5,556,079 | 9/1996 | West . | |
| 5,601,278 | 2/1997 | Graber . | |
| 5,758,987 | 6/1998 | Frame et al. | 403/408.1 X |

*Primary Examiner*—Terry Lee Melius
*Assistant Examiner*—William L. Miller
*Attorney, Agent, or Firm*—Sand & Sebolt

[57] ABSTRACT

A fence connector for interlocking pickets to cross supports to define sections of fence and for interlocking these fence sections to posts. The fence connector using retractable arms that retract for insertion into a hole and then deflect back to an expanded position upon full insertion resulting in a secure, snug connection. The fence connector including a stop for preventing axial movement of the connector upon insertion into a fence rail. A thin flexible piece of hinge may extend between and hinged interconnect an outer end of adjacent retractable arms.

26 Claims, 6 Drawing Sheets

FENCE CONNECTOR AND A METHOD OF ASSEMBLING FENCES

CROSS REFERENCE TO RELATED APPLICATION

This application is a continuation-in-part of application Ser. No. 08/715,814 filed on Sep. 16, 1996 now abandoned.

BACKGROUND OF THE INVENTION

1. Technical Field

The subject invention is directed to a connector. More particularly, the invention is directed to a connector for connecting hollow fence parts together such as a section of fence having a hollow cross support to a hollow vertical support or post, or hollow individual spindles to the hollow cross supports. Specifically, the invention is related to a connector with a pair of retractable, inward facing butterfly arms at each end of the connector whereby one pair is insertable into each of the hollow fence parts for securing the spindles to the cross supports, and the cross supports to the post by expanding once inserted into each hollow area.

2. Background Information

The use of fences in various forms has been known for thousands of years since the advent of land holding and animal domestication. Specifically, kings have used fences and other walls to secure their kingdoms by preventing entry by outsiders including enemies, while farmers have used fences to contain their livestock within a certain area and prohibit entry of predators into said area.

In more recent times farmers use of fences has continued, while use by others has grown. Residential use of fences, such as by home owners, also continues to grow. A second area of significant growth is by business owners who are desirous of keeping thieves, burglars and vagrants away from their inventory and buildings.

The types of fences used by these various users range from more secure types such as chain-link fences with or without barbed wire add-ons, and wrought iron gates to more decorative types such as cedar lapped fences, and picket fences. The metal fences such as chain-link tend to rust and generally are not aesthetically pleasing. The wood fences tend to need constant maintenance including painting or staining, and eventually replacement of rotted portions. In addition, both types are generally time consuming to build, and require nails, bolts, wire, or other difficult to use, time consuming to install, and difficult to hide fasteners to connect each section of fence to a vertical support.

SUMMARY OF THE INVENTION

Objectives of the invention include providing a plastic connector for fastening individual spindles to one or more cross supports thereby defining a section of fence and separately for fastening that section of fence to a fence support such as a post.

Another object of this invention is to provide a connector which snugly fastens hollow spindles to hollow cross supports as well as fastens a hollow cross support on the section of fence to a hollow post.

Yet another object of this invention is to provide a connector that is easy to use and quickly snaps the fence parts together.

Still another object of this invention is to provide a connector that significantly reduces the time and effort involved in building a new fence.

A further object of this invention is to provide a wear resistant, rust resistant connector.

Still other advantages and benefits of the invention will become apparent to those skilled in the art upon a reading and understanding of the following detailed description.

BRIEF DESCRIPTION OF THE DRAWINGS

Preferred embodiments of the invention, illustrative of the best modes in which the applicant has contemplated applying the principles, are set forth in the following description and are shown in the drawings and are particularly and distinctly pointed out an set forth in the appended claims.

Similar numerals refer to similar parts throughout the drawings.

DESCRIPTION OF THE PREFERRED EMBODIMENTS

Figure 1:
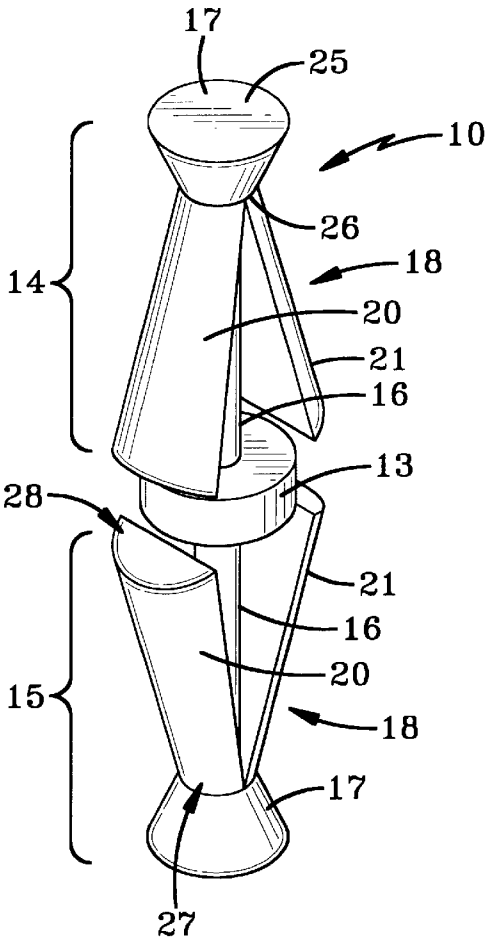
FIG. 1 an overall perspective view of the preferred embodiment of a connector.

The overall arrangement of the preferred construction of a connector 10 for fastening fence parts together such as a section of fence 11 to a support 12 can best be understood by reference to FIG. 1, while the overall method of using the connector 10 to fasten the section of fence 11 to the support 12 can best be understood by reference to FIGS. 2–6. The connector 10 and method are equally applicable to the assembly of the various fence parts together as described below.

As illustrated in FIG. 1, a connector 10 has a central disk 13 and expandable extensions 14 and 15 of identical construction and extending from opposing faces of central disk 13. Each expandable extension 14 and 15 includes an elongated support shaft 16, a stop 17, and a retractable locking mechanism 18. In accordance with the present invention, retractable locking mechanism 18 on each extension 14 and 15 has a pair of retractable, inward facing butterfly arms or toggle wings 20 and 21.

Figure 2:
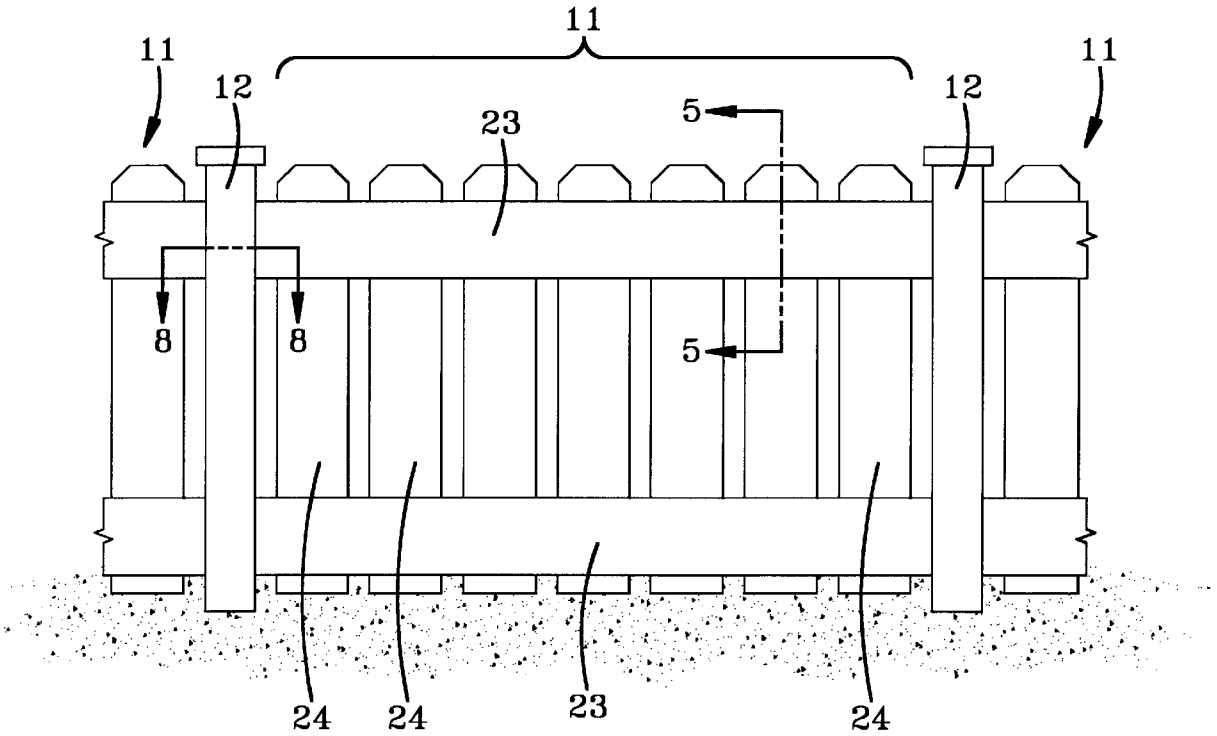
FIG. 2 is a rear elevational view of a plurality of spindles or pickets mounted to cross supports thereby defining a fence section where several fence sections are similarly mounted on two poles all of which are using a plurality of the connectors of FIG. 1.

As shown in FIG. 2, fence parts or members are connected together by connectors 10 thereby defining a fence. For example, fence sections 11 are connected to supports 12 by connectors 10. Specifically, each connector 10 is used to connect an end of one fence member to an end of a second fence member such as one section of fence 11 to one stationary support 12 which is a post or a wall. Each fence section 11 typically includes one or more relatively horizontal cross supports 23 for supporting the actual fencing 24 typically in the form of spindles, pickets or slats, or which may be any transversely extended material extending from the one or more horizontal cross supports 23 on each fence section 11. Fencing 24 may be vertical or diagonal and may be a wire mesh, lattice, vertical pickets, or other means of prohibiting access therethrough. These individual pieces of fencing 24 are each connected to cross supports 23 by connectors 10 in a substantially identical manner as the sections of fence 11 via cross supports 23 to the posts 12. For this reason, the description below of the connectors and the connecting method will be described with reference to the fencing to the cross supports although equally applicable to the cross supports to the posts.

Connector 10 as is shown in FIG. 1, is generally elongated in shape as it extends axially from one end of connector 10 defined by the stop 17 on the first expandable extension 14 to the other end of connector 10 defined by the stop 17 on the second expandable extension 15. Specifically, the parts of the connector 10 from end to end are stop 17 of extension 14, elongated shaft 16 of extension 14, central disk 13, elongated shaft 16 of extension 15, and stop 17 of extension 15. Each elongated shaft 16 is at least partially enveloped by one of the retractable locking mechanisms 18.

Central disk 13 is a cylindrically shaped disk with a pair of planar end faces of circular configuration. One elongated shaft 16 extends from the center of each planar end face to one of the stops 17 defining a central axis from one stop 17 to the other stop 17.

Each stop 17 is of a conical shape. Specifically, each conical shaped stop 17 has a back face 25 opposite a front face 26 from which shaft 16 extends.

Figure 5:
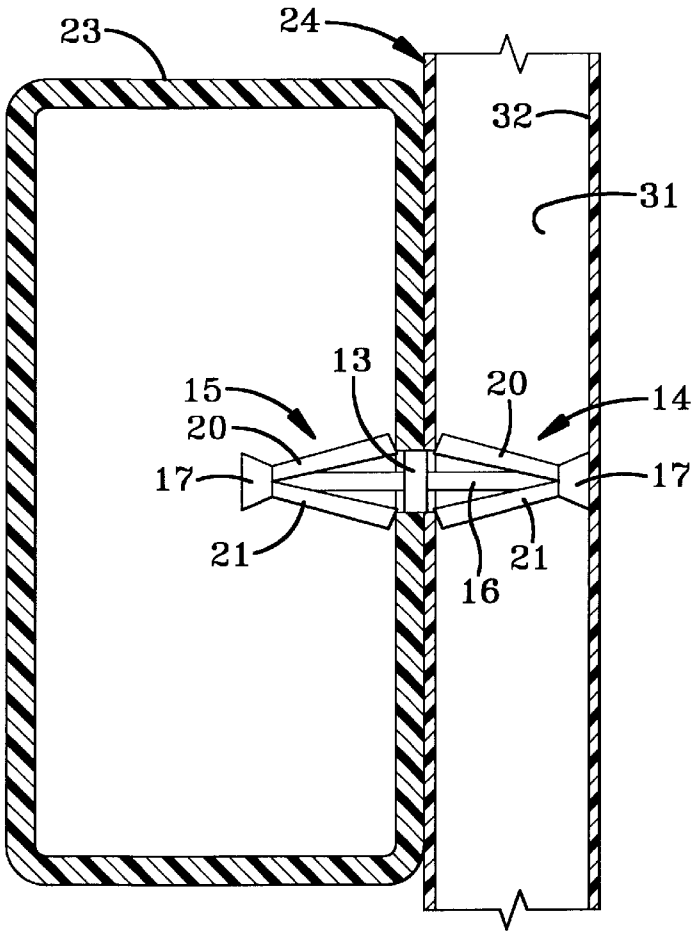
FIG. 5 is a side sectional view of the connector of FIG. 4 fully inserted into both the picket and e cross support.

Each retractable locking mechanism 18 is a pair of retractable butterfly arms 20 and 21. Each arm 20 and 21, of each extension 14 and 15, has a first end 27 affixed to its respective extension 14 or 15 at front face 26, and a second end 28 set apart from its respective elongated shaft 16. Specifically, each retractable butterfly arm 20 and 21 naturally expands angularly outward away from the central axis and the adjacent elongated shaft 16 that the arm partially envelopes so that second end 28 is set apart from shaft 16. This angularly outward extension away from the central axis is in an inward facing manner toward the central disk 13 such that the overall elongated connector 10 takes on a diamond-like configuration when viewed from the side as shown in FIG. 5.

Each arm 20 and 21 of each retractable locking mechanism 18 is deflectable or otherwise retractable from this diamond-like configuration. Specifically, each arm is elastic so as to allow bending in any direction from the straight, resting position as shown in FIG. 1 to a curved, loaded position as shown with reference to extension 14 in FIG. 3 and extension 15 in FIG. 4. Preferentially, each arm 20 and 21 is deflectable inward about its fixed first end 27 and toward the central axis such that each pair of butterfly arms substantially envelopes its respective elongated shaft 16. The second end 28 of each arm is adjacent the elongated shaft 16 when the arm is fully deflected inward and this allows the respective extension to be inserted into a hole.

The arms are preferably each semi-cylindrical in shape. When both arms 20 and 21 of one of the extensions are retracted against the shaft 16, connector 10 is substantially cylindrical so as to be insertable into a circular hole.

After every retraction, the butterfly arm will return to the straight, resting position, angularly extending away from the central axis, as soon as the bending force or blocking body is removed.

Figure 4:
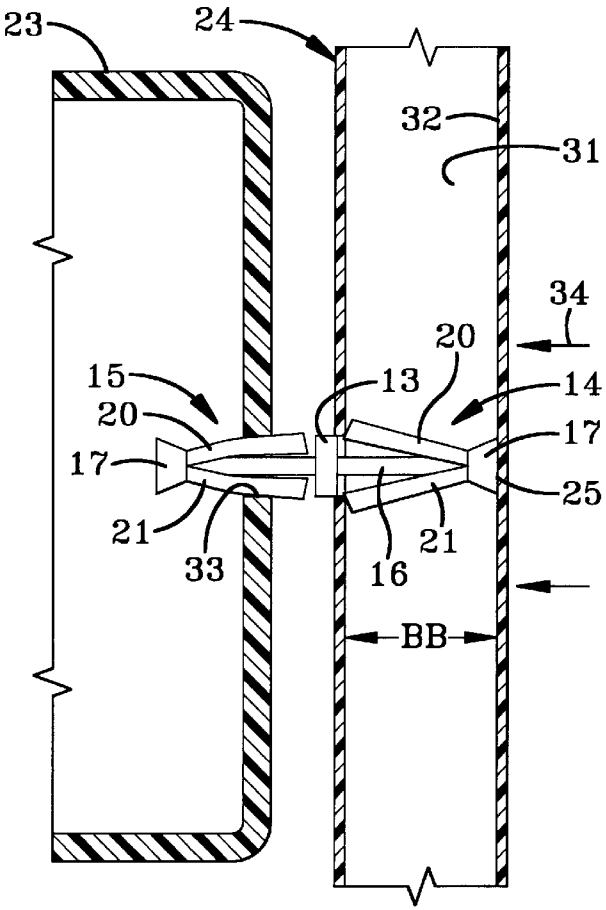
FIG. 4 is a side sectional view of the connector of FIG. 3 fully inserted into the picket and partially inserted into one of the cross supports of FIG. 2.
Figure 3:
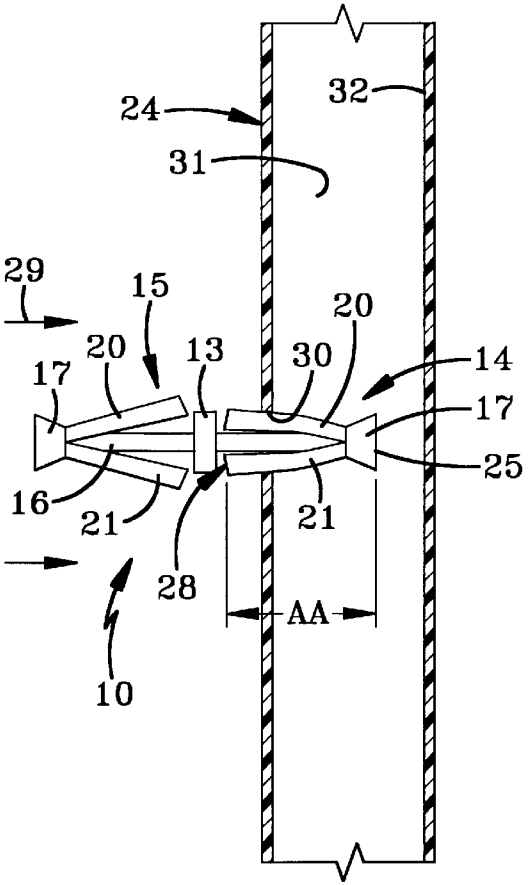
FIG. 3 is a side sectional view of one connector of FIG. 1 partially inserted into a picket FIG. 2.

In operation, each connector 10 is used to connect fence parts such 25 as pickets 24, cross supports 23, and posts 12 to each other. FIGS. 3–5 describe the connection of one end of a picket 24 to one of the cross supports 23. Specifically, as is shown in FIG. 2, vertical picket 24 is connected to a hollow and relatively horizontal cross support 23 which will eventually define a section of fence 11 once all of the pickets are connected as shown in FIG. 2.

One type of fence, as is shown in FIGS. 2–5, is a standard picket fence where each section of fence 11 has two horizontal cross supports 23 with a plurality of vertical pickets 24. Each picket 24 contains one or more holes for receiving the connectors. In this embodiment as shown in FIG. 2, the picket has a hole in the proximity of each end of the picket that corresponds to the intended location of the cross supports 23. These cross supports 23 similarly include holes that correspond with the desired location and spacing of the pickets 24.

FIGS. 3–5 show the sequence of connecting a picket 24 to a cross support 23. In FIG. 3, connector 10 is inserted into a hole 30 in picket 24 as shown by arrows 29. Specifically, stop 17 of extension 14 is inserted into hole 30. As the connector 10 slides into the hole 30, the butterfly arms 20 and 21 retract or bend inward toward the central axis so as to pass through the hole as is shown in FIG. 3.

As is shown in FIG. 4, the distance along the central axis from the back side of each stop 17 to approximately the mid-section of each second end is shown as AA and is the same as the depth BB of the hollow interior cavity 31 of each picket 24. This causes the butterfly arms 20 and 21 that are inserted into picket 24 to reopen from the retracted state and to snugly seat around the periphery of hole 30. The result is that stop 17 firmly rests against back wall 32 in cavity 31 and second end 28 of the arms wedge along the periphery of hole 30 to rigidly secure the connector within picket 24. Further insertion of the connector 10 is impossible. The connector must be fully inserted and this occurs only after the butterfly arms 20 and 21 have almost completely passed through the hole and reopened.

This snugly seated connector 10 within picket 24 is shown in FIG. 4. It is preferential that connector 10 is always inserted first into the pickets and then to the cross supports. This allows sufficient force to be applied to assure extension 14 is inserted far enough to allow butterfly arms 20 and 21 thereon to reopen and seat snugly therein. This assembly process results in properly seated connectors.

After all of the connectors in a given picket have been inserted, then the picket is ready for connection to cross supports 23. Similar to the connection process to the picket 24, the stop 17 of the other end of the connectors, i.e., extension 15 is inserted into a hole 33 in the post as shown by arrows 34. As the connector 10 slides into the hole 33 as is shown in FIG. 4, the butterfly arms 20 and 21 retract inward toward the central axis so as to pass through the hole as is shown in FIG. 4. After the arms 20 and 21 have passed completely through hole 33, the arms 20 and 21 reopen from the retracted state and snugly seat around the periphery of hole 33.

Stop 17 of the other extension 14 is snugly resting against wall 32 thereby supplying sufficient rigidity to the central axis of the connector so the extension 15 passes through hole 33 and reopens properly. The result is second end 28 of the arms 20 and 21 of extension 15 reopen and wedged along the periphery of hole 33 as is shown in FIG. 5.

The central disk 13 fills holes 30 and 33 to further add rigidity to the connection. This connector supplies a snug and tight connection between the cross support 23 and post 12.

After all of the connectors 10 in the picket 24 have been inserted and connected in all of the cross supports 23, then this process of FIGS. 3–5 is repeated to install all of the pickets to the cross supports to thereby define a section of fence 11. After one or more sections of fence 11 are created, the section or sections are ready for up-right attachment to posts 12 or a wall.

Figure 6:
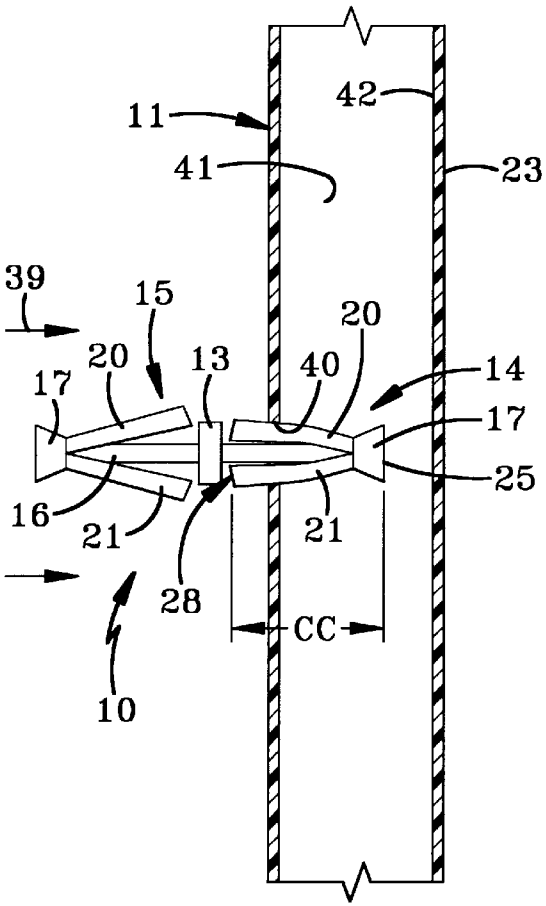
FIG. 6 is a side sectional view of one connector of FIG. 1 partially inserted into a cross support of FIG. 2.

Connectors 10 are used to connect cross supports 23 to posts 12 also. FIG. 6 shows the connection of one end of a section of fence 11 (defined as a plurality of pickets 24 connected to one or more cross supports 23) to a stationary support 12 as indicated above. Specifically, as is shown in FIG. 6, a hollow and relatively horizontal cross support 23 on a section of fence 11, is connected to hollow vertical post 12 which is sunken into the ground.

In the type of fence as is shown in FIG. 2, the standard picket fence includes sections of fence 11 each having two horizontal cross supports 23 with a plurality of vertical pickets 24. These sections as assembled in the above discussion are affixable to posts 12 whereby the fence takes shape. Each cross support 23 contains a hole that is located in from its end approximately 25% of the width of any post 12. This allows two adjacent sections of fence to be affixed at two cross supports to the same post adjacently meeting end-to-end on the same face of the post. Correspondingly, each post used with this embodiment of fence contains two pair of adjacent holes for receiving these adjacent sections of fence where typically one pair is near the top of the post and the other pair is near ground level.

In addition, supplemental support posts may be provided for supporting the mid-section of a fence section 11. In this case, the hole in the cross support corresponding to this mid-section post is a singular hole.

Of course, prior to any connecting, the fence posts 12 are positioned approximately the same distance apart. This allows the ends of each cross support 23 in two adjacent sections of fence to be affixed to a post positioned therebetween. In addition, if mid-section supports are desired, these posts are positioned as needed and desired.

The sequence of connecting of fence section 11 to post 12 where the post is acting as a mid-section support is very similar to connecting pickets to the supports. In FIG. 6, connector 10 is inserted into a hole 40 in cross support 23 as shown by arrows 39. Specifically, stop 17 of extension 14 is inserted into hole 40. As the connector 10 slides into the hole 40, the butterfly arms 20 and 21 retract or bend inward toward the central axis so as to pass through the hole as is shown in FIG. 6.

Figure 7:
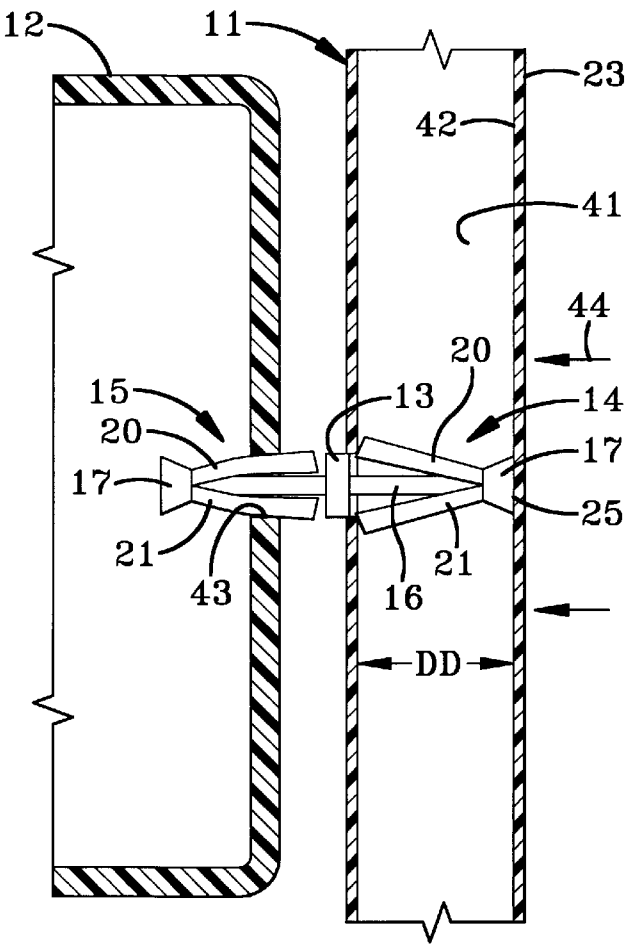
FIG. 7 is a side sectional view of the connector of FIG. 6 fully inserted into the cross support of the fence section and partially inserted into one of the fence posts of FIG. 2

As is shown in FIG. 7, the distance along the central axis from the back side of each stop 13 to approximately the mid-section of each second end is shown as CC and is the same as the depth DD of the hollow interior cavity 41 of each cross support 23. This causes the butterfly arms 20 and 21 that are inserted into cross support 23 to reopen from the retracted state and to snugly seat around the periphery of hole 40. The result is that stop 17 firmly rests against back wall 42 in cavity 41 and second end 28 of the arms wedge along the periphery of hole 40 to rigidly secure the connector within cross support 23. Further insertion of the connector 10 is impossible. The connector must be fully inserted and this occurs only after the butterfly arms 20 and 21 have almost completely passed through the hole and reopened.

This snugly seated connector 10 within cross support 23 is shown in FIG. 7. It is preferential that connector 10 is always inserted first into the cross supports and then to the posts. This allows sufficient force to be applied to assure extension 14 is inserted far enough to allow butterfly arms 20 and 21 thereon to reopen and seat snugly therein. This assembly process results in properly seated connectors.

After all of the connectors in a given section of fence 11 have been inserted, then the fence section 11 is ready for connection to posts 12. Similar to the connection process to the cross supports 23, the stop 17 of the other end of the connectors, i.e., extension 15 is inserted into a hole 43 in the post as shown by arrows 44. As the connector 10 slides into the hole 43 as is shown in FIG. 7, the butterfly arms 20 and 21 retract inward toward the central axis so as to pass through the hole as is shown in FIG. 4. After the arms 20 and 21 have passed completely through hole 43, the arms 20 and 21 reopen from the retracted state and snugly seat around the periphery of hole 43.

Figure 8:
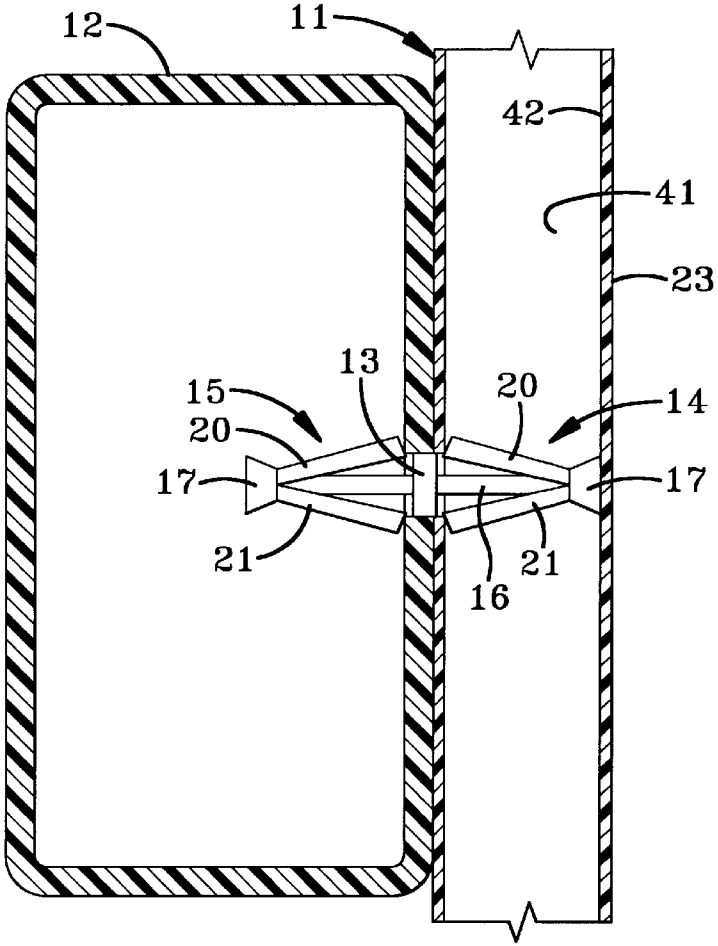
FIG. 8 is a side sectional view of the connector of FIG. 7 fully inserted into both the cross support of the fence section and the fence post.

Stop 17 of the other extension 14 is snugly resting against wall 42 thereby supplying sufficient rigidity to the central axis of the connector so the extension 15 passes through hole 43 and reopens properly. The result is second end 28 of the arms 20 and 21 of extension 15 reopen and wedged along the periphery of hole 43 as is shown in FIG. 8.

The central disk 13 fills holes 40 and 43 to further add rigidity to the connection. This connector supplies a snug and tight connection between the cross support 23 and post 12.

Figure 9:
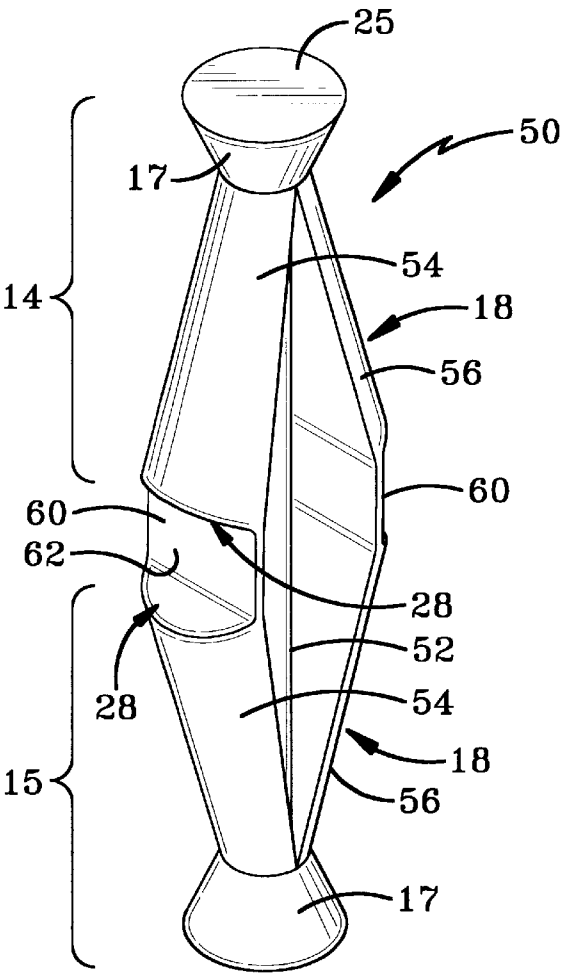
FIG. 9 is an overall perspective view of a second embodiment of the connector.

A second embodiment of the connector is shown in FIG. 9 and is indicated at 50. Connector 50 is generally similar to connector 10 of FIG. 1 and 3–8, and includes expandable extensions 14 and 15. Each expandable extension 14 and 15 includes a stop 17 and a retractable locking mechanisms 18. Connector 50 is free of central disk 13 and includes a one-piece elongated support shaft 52 rather than the pair of support shafts 16 and central disk 13 of connector 10.

In accordance with the present invention, retractable locking mechanisms 18 of extensions 14 and 15 include retractable butterfly arms 54 and 56 which are generally similar to butterfly arms 20 and 21 of connector 10, but which have second ends 28 interconnected by a thin flexible substantially flat hinge 60. Hinge 60 of arms 54 extends substantially parallel to hinge 60 of arms 56. Hinge 60 of each pair of arms 54 and 56 attaches to an inner surface of second ends 28 to form a gap 62 between second ends 28 and the outer surface of hinge 60. Second ends 28 of respective pairs of arms 54 and 56 extend towards one another to form an outwardly extending latching shoulder.

Figure 10:
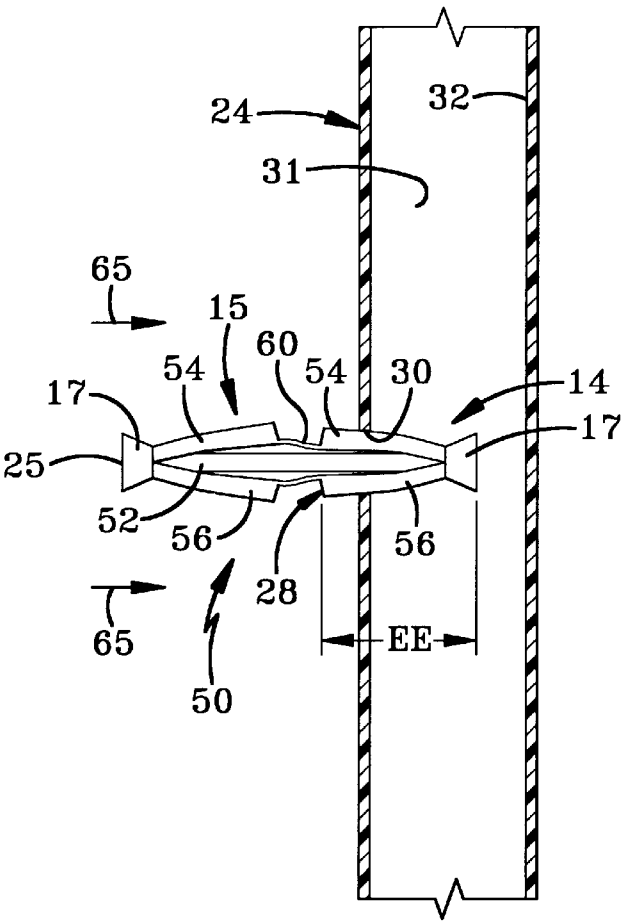
FIG. 10 is an elevational view of one connector of FIG. 9 partially inserted into a picket shown in section.
Figure 12:
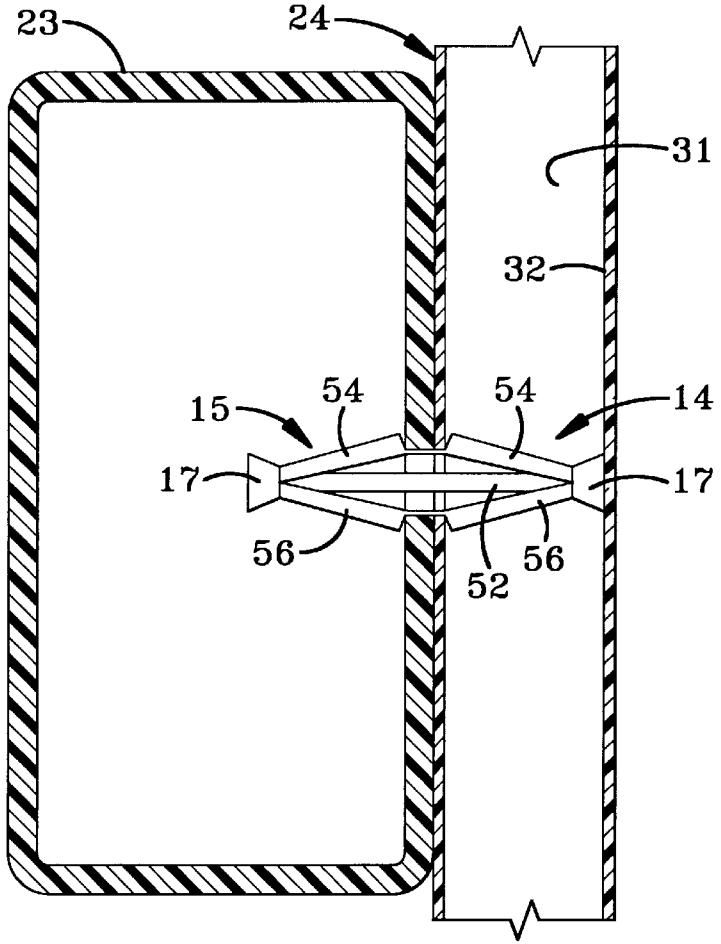
FIG. 12 is an elevational view of the connector of FIG. 11 fully inserted into both the picket and the cross support.
Figure 11:
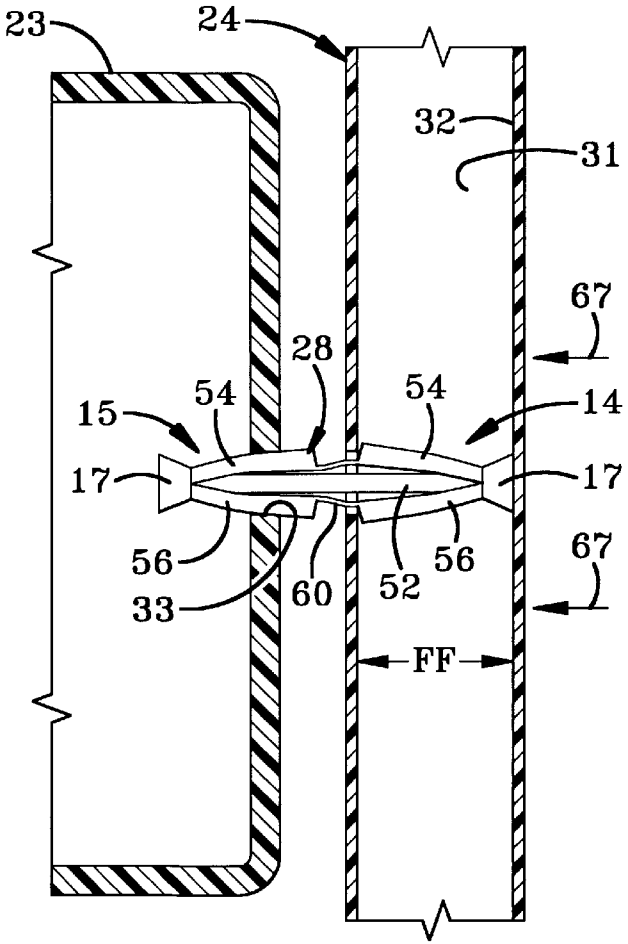
FIG. 11 is an elevational view of the connector of FIG. 10 fully inserted into the picket and partially inserted into one of the cross supports.

The method of operation of connectors 50 is similar to the method of operation of connector 10 allowing connectors 50 to be used to connect fence parts such as pickets 24, cross supports 23, and posts 12 to one another. FIGS. 10–12 show the connection of one end of a picket 24 to one of the cross supports 23. Connector 50 is shown in FIG. 3 with one end thereof partially inserted into hole 30 of picket 24. Pressure is applied to back face 25 of extension 15 in the direction of arrows 65 causing butterfly arms 54 and 56 of extension 14 to retract or bend inward toward support shaft 52 allowing extension 14 to pass through hole 30 as shown in FIG. 10.

As shown in FIGS. 10 and 11, the distance along the central axis from the back side of each stop 17 to approximately the mid section of each second end 28 is shown as EE and is the same as the depth FF of the hollow interior cavity 31 of each picket 24. This causes the butterfly arms 54 and 56 that are inserted into picket 24 to reopen from the retracted state and to snugly seat around the periphery of hole 30. The result is that stop 17 firmly rests against back wall 32 and cavity 31 and the latching shoulder formed by second end 28 of the arms wedges along the periphery of hole 30 to rigidly secure the connector within picket 24. Further insertion of the connector 10 is impossible. The connector must be fully inserted and this occurs only after the butterfly arms 54 and 56 have almost completely passed through the hole and have reopened.

This snug seated connector 50 within picket 24 is shown in FIG. 11. It is preferential that connector 50 is also inserted first into the pickets and then to the cross supports. This allows sufficient force to be applied to assure extension 14 is inserted far enough to allow butterfly arms 54 and 56 thereof to reopen and seat snugly therein. This assembly process results in properly seated connectors.

After all the connectors in a given picket have been inserted, then the picket is ready for connection to cross supports 23. Similar to the connection process to the picket 24, the stop 17 of the other end of the connectors, i.e., extension 15 is inserted into a hole 33 in the post as shown by arrows 67 (FIG. 11). As the connector slides into hole 33, butterfly arms 54 and 56 thereof retract inward toward the central axis so as to pass through the hole as shown in FIG. 11. Second end 28 of arms 54 and 56 pull hinges 60 inwardly causing hinges 60 to bend and deform slightly. As arms 54 and 56 of extension 15 retract inwardly causing hinge 60 to bend or flex, hinge 60 will pull ends 28 of arms 54 and 56 of extension 14 slightly inwardly but not a sufficient distance which would allow the latching shoulder of second ends 28 to clear the peripheral edge of hole 30. That is, arms 54 and 56 of extension 14 will not release their engagement within picket 24. After arms 54 and 56 of extension 15 have passed completely through hole 33, the resilient properties of arms 54 and 56 cause the arms to reopen from the retracted state and snugly seat around the periphery of hole 33 (FIG. 12). Stop 17 of extension 14 is snugly resting against wall 32 thereby supplying sufficient rigidity to the central axis of the connector allowing extension 15 to pass through hole 33 and reopen properly. The result is that the latching shoulders of end 28 of extension 15 wedge along the periphery of hole 33 thus interconnecting picket 24 to cross support 23.

Hinge 60 has a length substantially equal to the combined thickness of the sidewalls of picket 24 and support 23 (FIG. 12). Hinge 60 abuts the edge of holes 30 and 33 with the walls of picket 24 and cross support 23 filling gap 62 formed between ends 28 of the pairs of arms 54 and 56.

After all of connectors 50 in the picket 24 have been inserted and connected in all of the cross supports 23, this process shown in FIGS. 10–12 is repeated to install all of the pickets to the cross supports to thereby define a section of fence 11. After one or more sections of fence 11 are created, the section or sections are ready for upright attachment to posts 12 or a wall. Connectors 50 are used to connect cross supports 23 to posts 12 in a manner similar to that described above with respect to connector 10.

In an alternative embodiment, the cross supports of two adjacent fence sections may be overlapped rather than abutted end-to-end by using a first connector between the post and a first cross support on a first fence section, and a second connector between the opposite wall of the first cross support and a second cross support on a second fence section.

Accordingly, the improved fence connector is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the descriptions and illustration of the invention by way of example, and the scope of the invention is not limited to the exact details shown or described.

Having now described the features, discoveries, and principles of the invention, the manner in which the improved fence connector is constructed and used, the characteristic of the construction, and the advantageous, new and useful results obtained; the new and useful structures, devices, elements, arrangements, parts, and combinations are set forth in the appended claims.

What is claimed is:

1. A connector adapted to secure one fence member with a sidewall having at least one hole therein to another fence member with a sidewall having at least one hole therein, said connector comprising:

an elongated shaft having first and second ends, and defining a central axis between the ends;

a retractable extension affixed to each of the first and second ends of the shaft, each retractable extension including at least a first deflectable arm having an outer end which extends obliquely away from the central axis; and a flexible hinge extending between said outer ends of said at least first deflectable arms.

2. The connector as defined in claim 1 further including a latching shoulder formed on the outer end of each said deflectable arm, each said latching shoulder being adapted to engage one of the sidewalls of the fence members.

3. The connector as defined in claim 2 in which each said deflectable arm includes a pivot, and in which each latching shoulder is positioned intermediate the hinge and the pivot.

4. The connector as defined in claim 2 in which the hinge is substantially flat and is connected to each deflectable arm adjacent an interior surface thereof forming a gap between the latching shoulder of the attached deflectable arms.

5. The connector as defined in claim 1 in which each retractable extension includes a second deflectable arm capable of deflecting from an expanded position to a retracted position where the at least first and second deflectable arms at least partially envelop the shaft, a latching shoulder being formed at the outer end of each second deflectable arm, a flexible hinge extending between the outer ends of said second deflectable arms.

6. The connector as defined in claim 1 wherein each retractable extension further includes a stop affixed to the elongated shaft for supplying axial support to the connector.

7. The connector as defined in claim 6 wherein at least one deflectable arm is mounted to the elongated shaft adjacent the stop.

8. The connector as defined in claim 7 in which the deflectable arms are manufactured of a resilient material.

9. The connector as defined in claim 1 in which at least a portion of each deflectable arm is formed with a arcuate cross section.

10. The connector as defined in claim 1 in which the deflectable arms are mounted adjacent opposite ends of the elongated shaft whereby the outer end of each deflectable arm extends obliquely away from the central axis and toward the other retractable extension.

11. A fence system comprising;

a hollow post having at least a first hole formed therein;

a section of fence comprising a plurality of pickets arranged and supported by a pair of hollow cross supports, where each cross support has at a least a first support hole formed in each of its ends;

a connector for insertion into the at least first post hole and one of the at least first support holes to interlock the hollow post to one of the hollow cross supports, the connector having an elongated shaft with first and second ends, and at least a first deflectable arm extending from each of the first and second ends;

a flexible hinge extending between the at least first deflectable arms opposite the attachment of the at least first deflectable arms to the shaft;

whereby each deflectable arm includes a latching shoulder and a pivot and in which the latching shoulder is positioned intermediate the hinge and the pivot; and in which one of the latching shoulders contacts the at least first post hole, and in which the other of the latching shoulders contacts the one of the at least first support holes when the fence system is assembled.

12. A method of connecting at least one of pickets to cross supports and cross supports to fence posts comprising:

inserting a first retractable extension of a fastener into a first hole in a first fence member, the first retractable extension having at least one deflectable arm;

locking the first retractable extension within the support hole after complete insertion;

inserting a second retractable extension of the fastener into a second hole in a second fence member capable of supporting the first fence member, the second retractable extension having at least one deflectable arm, the deflectable arm of the first retractable extension being hinged secured to a respective deflectable arm of a second retractable extension by a flexible hinge;

locking the second retractable extension within the second hole after complete insertion; and abutting a latching shoulder formed on a first retractable extension against a first fence section and abutting a second latching shoulder formed on a second retractable extension against the hole formed in a second fence member for preventing removal of the fastener from the first fence member and the second fence member.

13. The method as defined in claim 12 including the further step of positioning the flexible hinge within a first hole formed in a first fence member and a second hole formed in a second fence member when the latching shoulders are positioned adjacent the first hole formed in the first fence member and the second hole formed in the second fence member.

14. The method as defined in claim 13 in which the step of inserting a first retractable extension further includes the step of simultaneously causing the first retractable extension to retract into a first position having a first cross sectional area smaller than the area of the first hole in the first fence member.

15. The method as defined in claim 14 in which the step of locking the first retractable extension within the support hole further includes the step of expanding the first retractable extension of the fastener into a second position of a second cross sectional area larger than the area of the first hole and larger than the first cross sectional area.

16. The method as defined in claim 15 wherein the step of expanding the first retractable extension further includes the step of simultaneously stopping of the first retractable end from further insertion as an outermost tip of the first retractable end engages with a side within the hollow first fence member opposing the first hole.

17. The method as defined in claim 16 further comprising the step of:

subsequent to the locking step, inserting a second retractable extension of the fastener into the second hole in the second fence member capable of supporting the first fence member.

18. The method as defined in claim 16 wherein the step of inserting a second retractable extension further includes the step of simultaneously causing the second retractable extension to retract into a third position of a third cross sectional area smaller than the area of the second hole in the second fence member.

19. The method as defined in claim 18 wherein the step of locking the second retractable extension within the second hole further includes the step of expanding the second retractable extension of the fastener into a fourth position of a fourth cross sectional area larger than the area of the second hole and larger than the third cross sectional area.

20. A connector in combination with a first fence member with a sidewall having at least a first hole therein and a second fence member with a sidewall having at least a first hole therein, said connector securing the first fence member to the second fence member to prevent the fence members from being pulled apart; said connector comprising:

an elongated shaft having first and second ends, a central axis being defined between the ends;

a first deflectable arm having a first end mounted to the shaft;

a second deflectable arm having a first end mounted to the shaft;

the first and second deflectable arms having second ends;

the first and second deflectable arms extending toward each other;

the second ends of the first and second deflectable arms being spaced apart;

the first deflectable arm disposed inside the first fence member;

the second deflectable arm disposed inside the second fence member;

the connector preventing the first fence member from being pulled away from the second fence member; and a first stop connected to the first end of the shaft for preventing axial movement of the connector upon insertion of the connector into the first fence member.

21. The connector as set forth in claim 20, further comprising a second stop connected to the second end of the shaft.

22. The connector as set forth in claim 21, the first and second stops being of a frustoconic shape.

23. A fence system comprising:

a first fence member formed with a cavity therein and formed with at least a first hole, the cavity having a depth adjacent the at least first hole;

a connector having an elongated shaft terminating at first and second ends and defining a central axis between the first and second ends;

a first deflectable arm mounted to the first end of the shaft, the first deflectable arm having an outer end that extends obliquely away from the central axis;

the distance along the elongated shaft between the outer end of the first deflectable arm and the first end of the shaft being substantially equal to the depth of the cavity formed in the first fence member such that the first end of the shaft and the outer end of the first deflectable arm engage the fence member substantially simultaneously;

a second deflectable arm mounted to the second end of the shaft, the second deflectable arm having an outer end that extends obliquely away from the central axis; the first and second deflectable arms extending toward each other;

the outer ends of the first and second deflectable arms being spaced apart;

a second fence member formed with a cavity and formed with at least a first hole, the shaft extending through the first hole of the second fence member;

the second end of the shaft being disposed in the second fence member; and the second end of the second deflectable arm engaging the second fence member adjacent the first hole of the second fence member; the connector preventing the first fence member from being pulled away from the second fence member.

24. The fence system as set forth in claim 23, wherein the connector further comprises a central disk disposed on the elongated shaft between the first and second ends, the central disk having a diameter less than the at least first hole formed in the first fence member.

25. The fence system of claim 23, further comprising additional first and second deflectable arms connected to the shaft.

26. A fence system comprising:

a first fence member formed with a cavity therein and formed with at least a first hole, the cavity having a depth adjacent the at least first hole;

a connector having an elongated shaft terminating at first and second ends and defining a central axis between the first and second ends;

a first deflectable arm mounted to the first end of the shaft, the first deflectable arm having an outer end that extends obliquely away from the central axis;

the distance along the elongated shaft between the outer end of the first deflectable arm and the first end of the shaft being substantially equal to the depth of the cavity formed in the first fence member such that the first end of the shaft and the outer end of the first deflectable arm engage the fence member substantially simultaneously;

a first deflectable arm mounted to the second end of the shaft, the second deflectable arm having an outer end that extends obliquely away from the central axis; the first and second deflectable arms extending toward each other;

the outer ends of the first and second deflectable arms being spaced apart; and a first stop connected to the first end of the shaft and a second stop connected to the second end of the shaft.

* * * * *